US005529188A

United States Patent [19]

Coggswell

[11] Patent Number: 5,529,188

[45] Date of Patent: Jun. 25, 1996

[54] CHILD RESISTANT CARDED TYPE BLISTER FOLDER

[75] Inventor: Theodore W. Coggswell, Orange, N.J.

[73] Assignee: Becton Dickinson and Company, Franklin Lakes, N.J.

[21] Appl. No.: 314,115

[22] Filed: Sep. 28, 1994

[51] Int. Cl.[6] ..... B65D 83/04

[52] U.S. Cl. ..... 206/531; 206/469

[58] Field of Search ..... 206/461–463, 206/467, 469, 471, 528, 531, 532, 539, 820

[56] References Cited

U.S. PATENT DOCUMENTS

| | | | |
|---|---|---|---|
| 4,371,080 | 2/1983 | Haines | 206/469 |
| 4,429,792 | 2/1984 | Machbitz | 206/532 |
| 5,062,569 | 11/1991 | Hekal | 206/484 |
| 5,323,907 | 6/1994 | Kalvelage | 206/531 |

*Primary Examiner*—Jimmy G. Foster
*Attorney, Agent, or Firm*—Allen W. Wark

[57] ABSTRACT

A blister package includes an upper portion, a lower portion, and an intermediate portion sandwiched between the upper and lower portions, with the intermediate portion having two adjoining compartments formed from blisters for containing at least one medicament or the like therein, with one of the compartments for storing the medicament prior to opening. In addition, to facilitate opening of the package while providing increased resistance to opening by small children, the package includes a detent situated between the adjoining compartments to prevent unrestricted or free movement of the medicament from one compartment to the other. Also, a weakened area is formed in the lower portion beneath the adjoining empty compartment. Thus, to remove the medicament from the package, sufficient force must be exerted to move the medicament from the first blister past the detent into the empty blister and then force the medicament therefrom through the weakened area.

10 Claims, 4 Drawing Sheets

CHILD RESISTANT CARDED TYPE BLISTER FOLDER

FIELD OF THE INVENTION

The present invention generally relates to packages for medicaments and the like, and more specifically relates to a child resistant blister package for enclosing or storing a single or unit dose of at least one over the counter or ethical pharmaceutical medicament such as for example aspirin and other pain relievers, preferably in tablet, caplet, gelcap or like form, which is easily opened by adults but provides some resistance/difficulty to being opened by children.

BACKGROUND OF THE INVENTION

Individual packages for medicaments are well know in the art and are typically provided as physician samples, dose prescriptions and the like as is well known in the trade. Such packaging usually contain, for example, aspirin or other medicaments, which may or may not be used at the same time.

Accordingly, several problems and limitations have been associated with the use of such packages including being easily opened by small children as a result of insufficient resistance or difficulty to being opened.

Thus, there has been a need for a blister package, which would eliminate the problems and limitations associated with the prior packages discussed above, most significant of the problems being associated with child resistance.

SUMMARY OF THE INVENTION

In contrast to the prior packages discussed above, it has been found that a blister package particularly suited for use with a single or unit dose of at least one medicament in a unitary package can be constructed in accordance with the present invention. In addition, the blister package of the present invention is resistant to being opened by children and the like by increasing the difficulty of opening, while still being easily opened by adults.

The child resistant blister package of the present invention for containing at least one medicament or the like, includes an upper portion, a lower portion and an intermediate portion, with the intermediate portion situated between the upper portion and the lower portion, the intermediate portion including at least two adjoining compartments formed therein, with one of the adjoining compartments for storing the medicament during an inoperative position while the other compartment remains empty until the operative position, and weakened means formed in the lower portion and situated beneath the empty compartment for permitting passage of the medicament through the weakened area upon exertion of sufficient force, whereby a user may manipulate the medicament from the storing compartment to the empty compartment and then force the medicament through the weakened area from the empty compartment.

In the preferred embodiment, the blister package further includes detent means situated between the empty compartment and the storing compartment for preventing unrestricted movement of the medicament between the storing compartment and the empty compartment. Also, the weakened means includes at least one score line and the intermediate portion includes polyvinylchloride. In addition, the lower portion and the upper portion each include a laminate material, with the laminate of the lower portion includes layers of paper and foil with intermediate poly layers, and the weakened means includes at least one score line formed in the foil layer. Further, the intermediate portion includes polyvinylchloride and a pair of adjoining blisters formed therein, with each blister forming one of the compartments.

In addition, the child resistant blister package for containing at least one medicament or the like, includes an upper portion and a lower portion, each including a laminate material, an intermediate portion situated between the upper portion and the lower portion, with the intermediate portion including at least two adjoining blisters each having a corresponding compartment, with one of the compartments for storing the medicament during an inoperative position while the other compartment remains empty until the operative position, movement restricting means situated between the compartments for preventing free movement of the medicament between the compartments, and weakened means formed in the lower portion and situated beneath the empty compartment for permitting restricted passage of the medicament through the weakened area, whereby upon exertion of sufficient force, a user may move the medicament from the storing compartment past the movement restricting means into the empty compartment and then force the medicament from the empty compartment through the weakened area, wherein the movement restricting means includes a detent situated between the adjoining blisters and the weakened means includes at least one score line.

BRIEF DESCRIPTION OF THE DRAWINGS

The various features, objects, benefits, and advantages of the present invention will become more apparent upon reading the following detailed description of the preferred embodiments along with the appended claims in conjunction with the drawings, wherein like reference numerals identify corresponding components, and:

DETAILED DESCRIPTION OF THE PREFERRED EMBODIMENTS

The blister package of the present invention is illustrated in FIGS. 1–8, and generally designated as 10.

Figure 1:
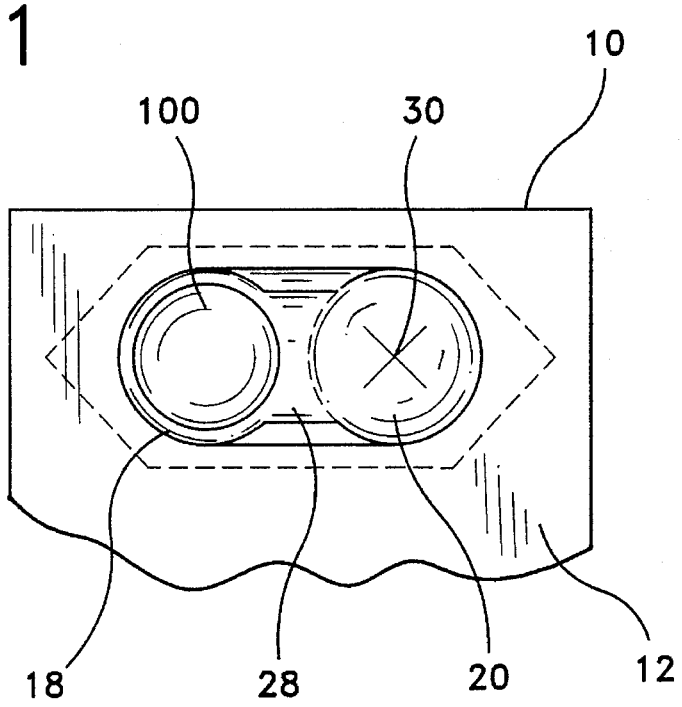
FIG. 1 is plan view of the blister package of the present invention having two compartments, with one of the compartments for storing the medicament.
Figure 2:
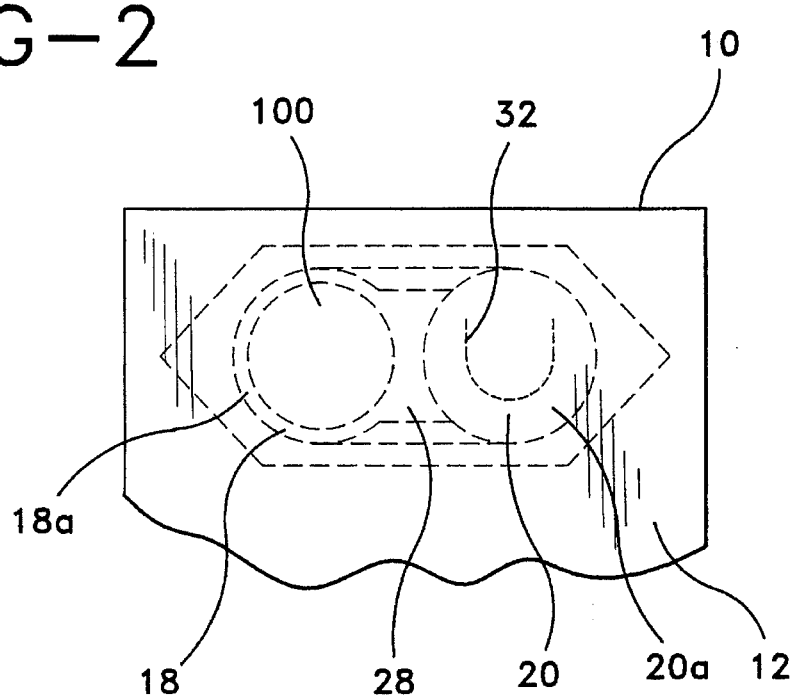
FIG. 2 is a bottom view of the blister package of the present invention illustrated in FIG. 1.

Referring to FIGS. 1 and 2, the blister package 10 includes an upper portion 12 and a lower portion 14, and an intermediate portion 16, with the intermediate portion 14 sealingly sandwiched between the upper and lower portions.

In the preferred embodiment of the blister package of the present invention illustrated in FIGS. 1 and 2, the intermediate portion 16 includes adjoining blisters each having corresponding compartments 18A, 20A separated by a restricting area, with the first compartment 18A storing the medicament 100 prior to opening of the blister package during an inoperative position. The restricting area acts a detent 28 so that the medicament does not freely move between the first compartment 18A and the second compartment without exerting some degree of force to overcome the detent 28 to move the medicament 100 from the first compartment 18A to the second compartment 20A in an operative opening position.

Also, in the preferred embodiment, the upper portion 12 preferably includes a 2–3 mil thick sheet of paper-poly film, the lower portion 14 includes a multiple-laminate material such as, for example, a 2–3 mil thick sheet of paper-poly-foil-poly film, and the intermediate portion 16 includes a layer of polyvinylchloride ("PVC") in either a clear or opaque-translucent. In this way, the poly portions of each laminate film are heat sealable to the paper and foil layers as well as the PVC by heat sealing and/or crimping. Also, the PVC can be easily molded to form the blisters 18, 20.

However, it should be appreciated that the particular method of manufacturing the blister package 10 of the present invention is not essential to the present invention such as those well known to persons skilled in the art, including for example the method disclosed, for example, in U.S. Pat. No. 3,327,843 (O'Meara et al.), the disclosures of which is hereby incorporated in its entirety. Also, the materials used for the blister package 10 are not essential to the present invention and may be made from a variety of commercially available material. Normally, manufacturers of the blister package will select the various manufacturing process and materials, based upon price, availability and application. However, to increase resistance to being opened, the paper layers are recommended to provide additional structural integrity and additional resistance to being opened by small children.

Figure 3:
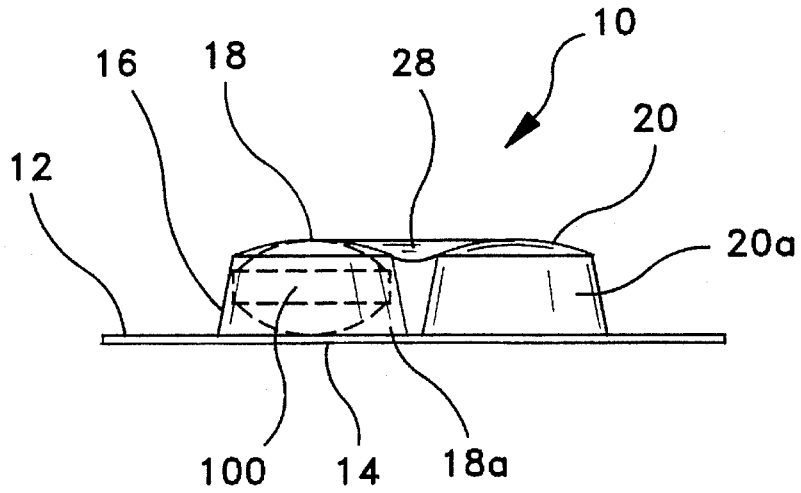
FIG. 3 is a side view of the blister package illustrated in FIG. 1 showing the package in an inoperative position, with the medicament situated in the storing compartment.
Figure 4:
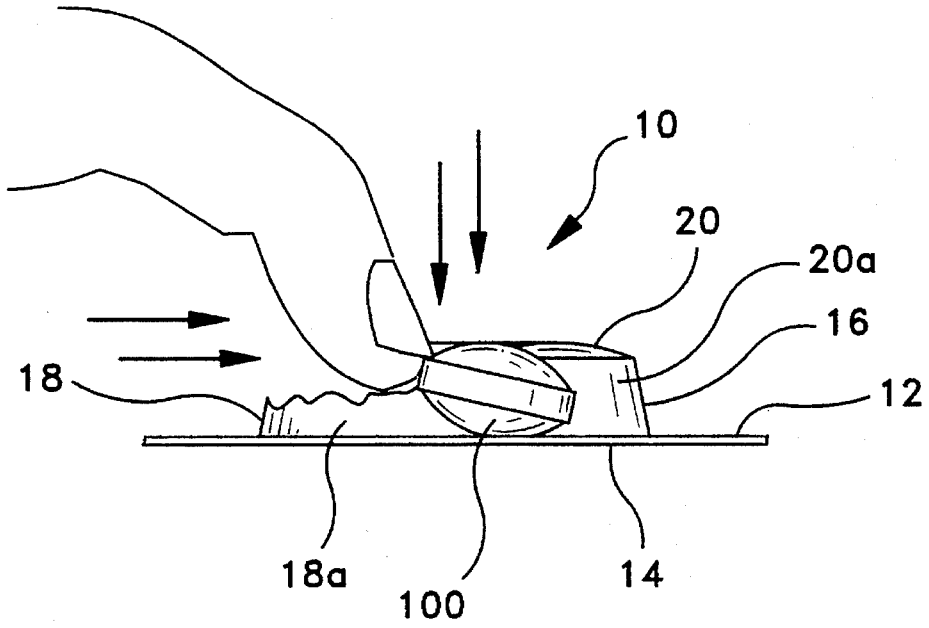
FIG. 4 is a side view of the blister package similar to FIG. 3 showing manipulation of the blister package to move the medicament from the storing compartment into the adjoining empty compartment.
Figure 5:
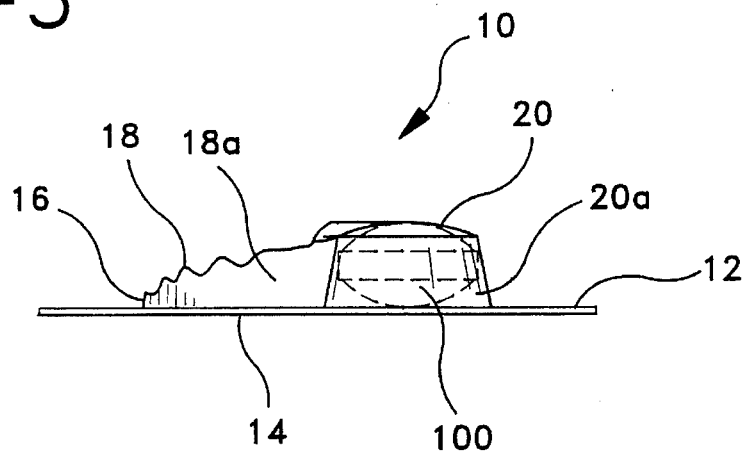
FIG. 5 is a side view of the blister package similar to FIG. 4 showing the package in an operative position, with the medicament situated in the empty compartment.
Figure 6:
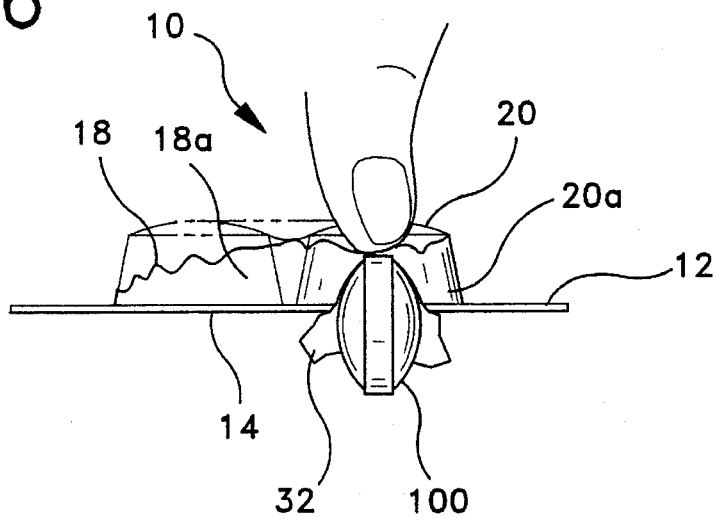
FIG. 6 is a side view of the blister package similar to FIG. 5 showing manipulation of the package to remove the medicament therefrom by forcing the medicament from the empty compartment through the lower portion.
Figure 8:
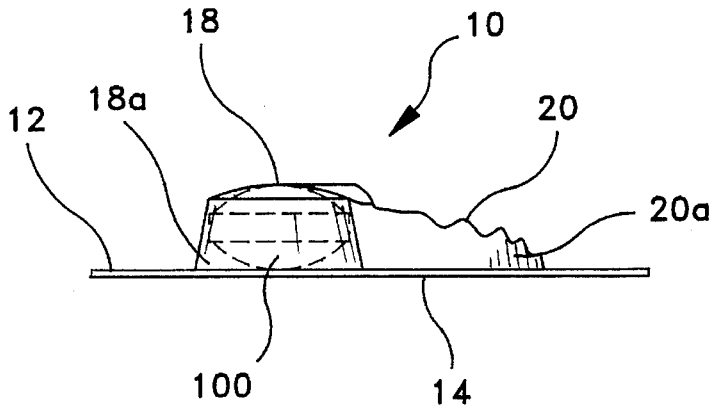
FIG. 8 is a side view of the blister package similar to FIG. 3 showing collapse of the adjoining empty compartment thereby locking or otherwise trapping the medicament in the storing compartment in the inoperative position.

Referring to FIGS. 1 and 2, the lower portion 14 includes a weakened area situated beneath the second compartment 20A, which in the preferred embodiment includes a pair of intersecting score lines 30 in the shape of an X formed in the foil layer and a tab 32 scored or die cut in the paper layer in the shape of a U. In this way, in order to remove the medicament 100 from the blister package, the user must at least partially collapse the first blister 18 and overcome the detent 28 to move or otherwise manipulate the medicament from the first compartment 18A to the second compartment 20A as illustrated in FIGS. 3–5. Next, the user must at least partially collapse the second blister 20 to force or otherwise manipulate the medicament 100 through the weakened area in the lower portion 14 from the second compartment 20A. It should be apparent to one skilled in the art that the weakened area may include other forms and shapes, while providing sufficient resistance to opening by small children, such as for example perforations and the like.

Figure 7A:
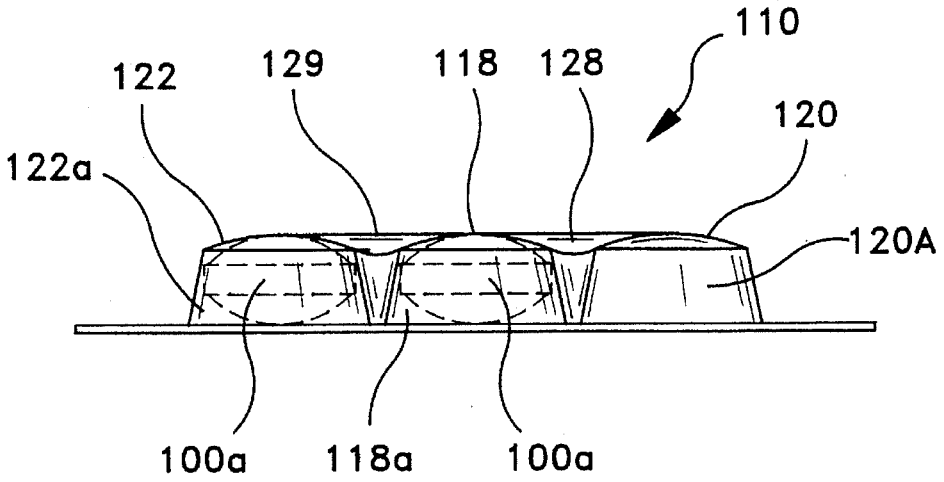
FIGS. 7A and 7B are side views of alternative embodiments of the blister package having three blisters and corresponding compartments.
Figure 7B:
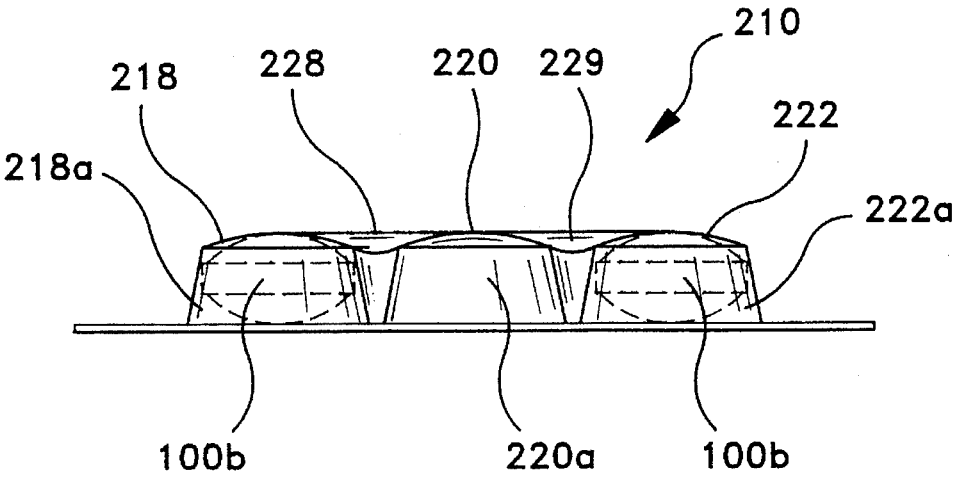

Referring to FIGS. 7A and 7B, alternative embodiments of the blister packaging 110, 210 are illustrated. Specifically, the packages each include three individual blisters 118, 120, 122, 218, 220, 222 with corresponding compartments 118A, 120A, 122A, 218A, 220A, 222A. In this way, the packages 110, 210 can store two individual medicaments 100A, 100B in compartments 118A, 122A, 218A, 222A for use.

In the one embodiment illustrated in FIG. 7A, the package 110 stores the medicaments 100A to one side of the empty compartment 120A, and the user can move them into the empty compartment past the detents 128, 129. In contrast, the embodiment illustrated in FIG. 7B, the package 210 stores medicaments 100B on both sides of the empty compartment 220A in the storing compartments 218A, 222A, and the user can move either medicament 100B into the empty compartment past either detent 228 or 229. In this ways the alternative embodiments can be used where the dose may vary or the time intervals for taking the medicaments. In addition, it should be appreciated that two or more different medicaments may be stored in the packages 110, 210 as well.

Operation and Use

Use of the blister package 10 of the present invention illustrated in FIGS. 3–6 will now be explained.

In the preferred embodiment, initially, a user places his or her thumb against the first blister 18 storing the medicament 100 with sufficient force to cause it to at least partially collapse and the medicament to move past the detent 28 from the first compartment 18A into the empty compartment 20A of the second blister 20. Next, the user places his or her thumb against the outside of the second blister 20 to cause it to at least partially collapse so that the medicament passes through the weakened area in the lower portion 14, i.e., through the paper layer and the foil layer, to expose the medicament 100. In this way, the blister package can be easily opened by adults who can manipulate the package from an inoperative position to an operative opening position, while provide some degree of resistance and difficulty to opening by small children.

As illustrated in FIG. 7, in the event a small child attempts to remove the medicament from the storing compartment 18A of the first blister 18A by twisting, biting or other means, he or she may effectively destroy the pre-formed configuration of the empty compartment 20A thereby locking or otherwise trapping the medicament 100 in the storage compartment 18A making it more and more difficult to move the medicament to the adjacent empty compartment 20A for removal.

While a preferred embodiment of the present invention has been described so as to enable one skilled in the art to practice the blister package of the present invention, it is to be understood that variations and modifications may be employed without departing from the concept and intent of the present invention as defined in the following claims. The preceding description is intended to be exemplary and should not be used to limit the scope of the invention. The scope of the invention should be determined only by reference to the following claims.

What is claimed is:

1. A child resistant blister package for containing at least one medicament, comprising:

an upper portion, a lower portion and an intermediate portion, with the intermediate portion situated between the upper portion and the lower portion;

said intermediate portion including at least two adjoining compartments formed therein, with one of said adjoining compartments for storing the medicament during an inoperative position while the other compartment remains empty until the operative position; and weakened means formed in said lower portion and situated beneath the empty compartment for permitting passage of said medicament through said weakened area upon exertion of sufficient force, whereby a user may manipulate the medicament from the storing compartment to the empty compartment and then force the medicament through the weakened area from the empty compartment.

2. The blister package defined in claim 1, further comprising detent means situated between said empty compartment and said storing compartment for preventing unrestricted movement of the medicament between the storing compartment and the empty compartment.

3. The blister package defined in claim 1, wherein said weakened means includes at least one score line.

4. The blister package defined in claim 1, wherein said intermediate portion includes polyvinylchloride.

5. The blister package defined in claim 1, wherein said lower portion and said upper portion each include a laminate material.

6. The blister package defined in claim 5, wherein said laminate of said lower portion includes layers of paper and foil with intermediate poly layers, and said weakened means includes at least one score line formed in said foil layer.

7. The blister package defined in claim 1, wherein said intermediate portion includes polyvinylchloride and a pair of adjoining blisters formed therein, with each blister forming one of said compartments.

8. A child resistant blister package for containing at least one medicament, comprising:

an upper portion and a lower portion, each including a laminate material;

an intermediate portion situated between the upper portion and the lower portion, with said intermediate portion including at least two adjoining blisters each having a corresponding compartment, with one of said compartments for storing the medicament during an inoperative position while the other compartment remains empty until the operative position;

movement restricting means situated between said compartments for preventing free movement of said medicament between said compartments; and weakened means formed in said lower portion and situated beneath the empty compartment for permitting restricted passage of said medicament through said weakened area, whereby upon exertion of sufficient force, a user may move the medicament from the storing compartment past the movement restricting means into the empty compartment and then force the medicament from the empty compartment through the weakened area.

9. The blister package defined in claim 8, wherein said movement restricting means includes a detent situated between said adjoining blisters.

10. The blister package defined in claim 9, wherein said weakened means includes at least one score line.

* * * * *